US008695503B2

(12) United States Patent
Park

(10) Patent No.: US 8,695,503 B2
(45) Date of Patent: Apr. 15, 2014

(54) APPARATUS AND METHOD FOR LOCKING AND ACTUATING A STRIPPER BLADE IN A PRINTER

(75) Inventor: Daniel Clark Park, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 415 days.

(21) Appl. No.: 13/223,163

(22) Filed: Aug. 31, 2011

(65) Prior Publication Data

US 2013/0051900 A1 Feb. 28, 2013

(51) Int. Cl.
*B41F 35/00* (2006.01)

(52) U.S. Cl.
USPC ..... 101/425; 101/483

(58) Field of Classification Search
USPC ..... 101/425
See application file for complete search history.

(56) References Cited

U.S. PATENT DOCUMENTS

| | | | | | |
|---|---|---|---|---|---|
| 3,731,624 | A * | 5/1973 | Kaneko et al. | ..... | 101/142 |
| 4,000,694 | A * | 1/1977 | Schroder | ..... | 101/365 |
| 4,707,108 | A | 11/1987 | Akio | | |
| 4,969,015 | A | 11/1990 | Sanpe | | |
| 5,073,800 | A | 12/1991 | Yamaguchi et al. | | |
| 5,081,504 | A | 1/1992 | Morisawa et al. | | |
| 5,091,753 | A | 2/1992 | Slapelis | | |
| 5,408,303 | A | 4/1995 | Fukunaga et al. | | |
| 5,452,660 | A * | 9/1995 | Stein | ..... | 101/425 |
| 5,570,775 | A * | 11/1996 | Kleinhans et al. | ..... | 198/635 |
| 5,953,034 | A * | 9/1999 | Salomon et al. | ..... | 347/103 |
| 6,151,044 | A | 11/2000 | Gaasch | | |
| 6,293,545 | B1 | 9/2001 | Hanks et al. | | |
| 6,729,236 | B2 * | 5/2004 | Knabe et al. | ..... | 101/423 |
| 6,925,282 | B2 | 8/2005 | Drawe et al. | | |
| 7,486,922 | B2 * | 2/2009 | Nakano et al. | ..... | 399/323 |
| 7,532,849 | B2 | 5/2009 | Akiba et al. | | |
| 7,677,717 | B2 | 3/2010 | Islam et al. | | |
| 8,042,589 | B2 * | 10/2011 | Hanada | ..... | 156/389 |
| 8,313,190 | B2 * | 11/2012 | Castillo et al. | ..... | 347/104 |
| 8,393,272 | B2 * | 3/2013 | Cyr et al. | ..... | 101/425 |

* cited by examiner

*Primary Examiner* — Anthony Nguyen
(74) *Attorney, Agent, or Firm* — Maginot, Moore & Beck, LLP

(57) ABSTRACT

An assembly for actuating a stripper blade in an indirect printer has been developed. The system includes a blade mounted to an elongated member, a first cam, a second cam, and an actuator configured to rotate the first and second cams. The elongated member is fixed in the vertical direction by a channel, and the first cam is configured to limit the horizontal movement of the elongated member. The second cam pivots the elongated member in and out of engagement with an image receiving member when the horizontal movement of the elongated member is constrained.

20 Claims, 9 Drawing Sheets

APPARATUS AND METHOD FOR LOCKING AND ACTUATING A STRIPPER BLADE IN A PRINTER

TECHNICAL FIELD

This disclosure relates generally to printers having a drum and, more particularly, to the components for facilitating removal of media from an imaging receiving member after the media has passed through a transfix nip.

BACKGROUND

In known indirect, or offset, printing systems having a drum, the print process includes an imaging phase and a transfer phase. In ink printing systems, the imaging phase is the portion of the print process in which the ink is ejected from the nozzles in one or more printheads in an image pattern onto an image receiving member surface. The image receiving member typically has a very thin layer of release agent on its surface to facilitate transfer of the image from the image receiving member. The transfer phase is the portion of the print process in which the ink image is transferred from the image receiving member onto a recording medium. The image transfer typically occurs by bringing a transfer roller into contact with the image receiving member to form a nip. A recording medium arrives at the nip as the image receiving member rotates the ink image through the nip. The pressure in the nip helps transfer the image formed of malleable inks from the image receiving member to the recording medium.

In some indirect printers, a stripper blade is used to intervene between the leading edge of a media leaving the transfer nip and the image receiving member to facilitate separation of the media from the image receiving member after the image is transferred to the media. The stripper is pressed against the image receiving member by an actuator, such as a solenoid, to facilitate separation of the leading edge of the sheet from the image receiving member. After the sheet has passed through the nip, the actuator moves the stripper blade out of contact with the image receiving member to prevent excessive wear of the blade and image receiving member. Manual maintenance operations are periodically performed to the image receiving member and stripper blade. A second actuator is required to unlock the stripper to enable manual movement of the stripper from the image receiving member to allow sufficient clearance for the components that perform the manual maintenance operations. Using multiple actuators to operate the stripper system results in undesirable noise and excess moving parts. Similar components in a printer, such as media diverters, also require mechanisms for pivoting arms and unlocking of the components to facilitate maintenance, such as clearing paper jams. Consequently, improved mechanisms for operating printer components would be beneficial.

SUMMARY

A pivoting assembly for a printer component has been developed that is simpler and requires fewer actuators. The pivoting assembly includes an elongated member having a first end and a second end, a protrusion extending from the elongated member, the protrusion extending transversely to a length of the elongated member from the first end of the elongated member to the second end of the elongated member, a pivot pin having a first end and a second end, the first end of the pivot pin being mounted through the elongated member at a position that enables the first end and the second end to move in a curved path about the pivot pin, a channel having a first horizontal planar surface and a second horizontal planar surface, the first planar surface and the second planar surface being parallel to one another and the second end of the pivot pin being positioned between the first horizontal planar surface and the second horizontal planar surface to constrain vertical movement of the pivot pin, a first cam positioned proximate the channel to enable the first cam to rotate past a portion of the pivot pin between the first end and the second end of the pivot pin and block a portion of the channel to stop horizontal movement of the pivot pin along the channel, a second cam positioned to enable the second cam to engage the protrusion extending from the elongated member, and an actuator having an output shaft that is operatively connected to the first cam and the second cam, the actuator rotates in a first rotational direction to rotate the second cam and the first cam until the first cam blocks the channel and prevents horizontal movement of the pivot pin in the channel and the second cam engages the protrusion extending from the elongated member and pivots the second end of the elongated member about the pivot pin in a first direction along the curved path to move the first end of the elongated member in the first direction along the curved path, and the actuator rotates in a second rotational direction that is opposite the first rotational direction to enable the elongated member to pivot along the curved path in a direction opposite the first direction, disengage the second cam from the protrusion extending from the elongated member, and move the first cam to a position that does not block the pivot pin in the channel.

A method of controlling pivoting movement of a printer component has been developed that facilitates movement of a printer component. The method includes rotating an actuator in a first rotational direction, rotating a first cam with the rotation of the actuator to position a portion of the first cam at a channel formed by two parallel surfaces to block horizontal movement of a pivot pin within the channel, the pivot pin being connected to the elongated member, which has a first end and a second end, rotating a second cam with the rotation of the actuator to move a surface on the second cam against a protrusion extending from the elongated member, the protrusion extending transversely to a length of the elongated member from the first end of the elongated member to the second end of the elongated member, and further rotation of the second cam with the actuator moves the protrusion in a curved path about the pivot pin to pivot the first end of the elongated member about the pivot pin.

BRIEF DESCRIPTION OF THE DRAWINGS

The foregoing aspects and other features of an ink printer implementing a stripper blade assembly are explained in the following description, taken in connection with the accompanying drawings, wherein.

DETAILED DESCRIPTION

Figure 1:
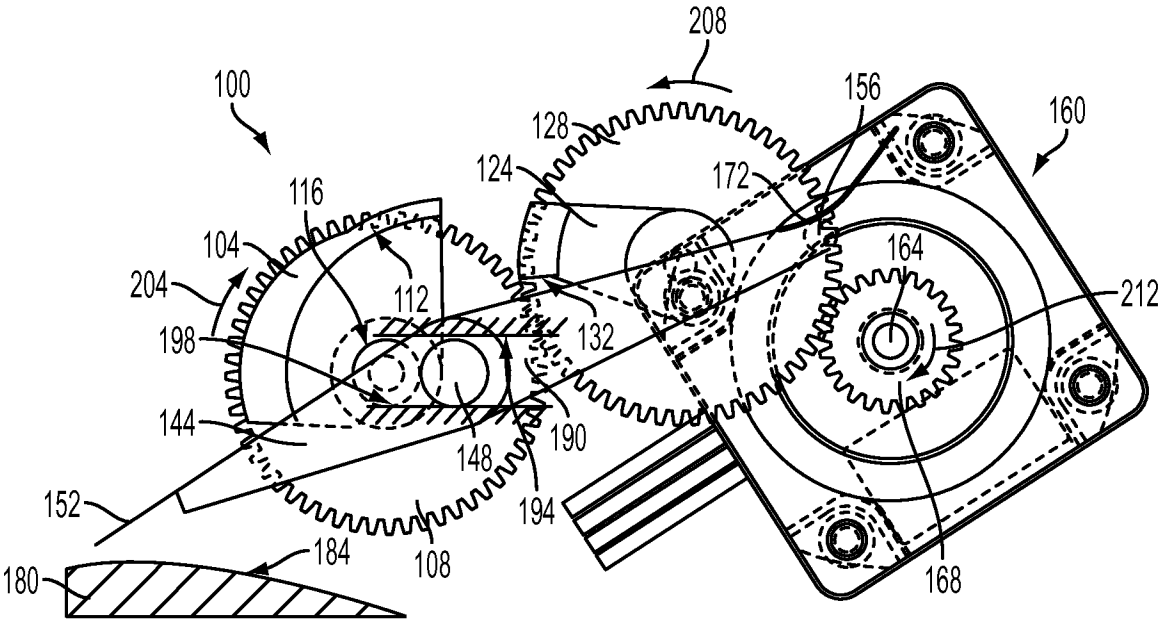
FIG. 1 is a view of a stripper blade assembly shown in an unlocked position.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like.

A stripper blade assembly 100 is shown in FIG. 1 in an unlocked position. The stripper blade assembly 100 is positioned in an indirect printer in proximity to an image receiving member 180 having a rotating surface 184. The stripper blade assembly 100 includes a first cam 104, a first gear 108, a second cam 124, a second gear 128, a motor 160, an elongated member 144, a channel 190, and a return spring 172. The first gear 108 is operatively connected to the first cam 104, wherein rotating the first gear 108 rotates the first cam 104. The first cam 104 and the first gear 108 rotate about a common axis. The second gear 128 is operatively connected to the second cam 124 so the second gear 128 and the second cam 124 rotate about a common axis. The first gear 108 and the second gear 128 are substantially coplanar, and the first cam 104 and second cam 124 are positioned between the plane of the first 108 and second 128 gears and the elongated member 144. Each of the first gear 108 and the second gear 128 have a plurality of teeth around the circumference of the gear, the teeth of the first gear 108 being intermeshed with the teeth of the second gear 128 to enable the second gear 128 to rotate the first gear 108. The motor 160 has an output shaft 164 connected to a drive gear 168. The drive gear 168 has teeth that intermesh with the teeth of the second gear 128 to enable the motor 160 to rotate the second gear 128 and cam 124, which simultaneously rotates the first gear 108 and cam 104. In the embodiment of FIG. 1, the first gear 108 and second gear 128 are substantially the same size, although in other embodiments one gear may be larger than the other.

The elongated member 144 includes a first end and a second end, the first end including a blade 152 that extends beyond the first end of the elongated member 144. A pin 156 is mounted on the second end of the elongated member 144 and the pin extends transversely to the length of the elongated member 144 into a space between the elongated member 144 and the second gear 128. The pin 156 is configured to engage an actuation surface 132 on the second cam. The elongated member 144 further includes a pivot pin 148 that is fixedly mounted to the elongated member 144 at a position near the center of the elongated member 144. The pivot pin 148 is substantially cylindrical and is constrained from movement in the vertical direction by two parallel horizontal surfaces 194, 198, which form the channel 190. The pivot pin 148 is configured to engage cam surfaces on the first cam 104, which guide the horizontal position of the pivot pin 148 when engaged. In the unlocked position depicted in FIG. 1, the pivot pin 148 is limited in the horizontal direction on one side.

The first cam 104 includes a curved outer cam surface 112 and a curved inner cam surface 116, the inner cam surface 116 being concentric with the center of the first gear 108. The outer cam surface 112 is positioned outside the inner cam surface 116 and is arranged to enable the distance from the inner cam surface 116 to the outer cam surface 112 within channel 190 to decrease as the first cam 104 is rotated in direction 204. The outer cam surface 112 extends around approximately one quarter of the circumference of the first gear 108 in the illustrated embodiment, while the inner cam surface 116 is a circle. The inner 116 and outer 112 cam surfaces are configured to guide the pivot pin 148 as the first cam 104 rotates in direction 204 and to constrain the horizontal movement of the pivot pin 148 until the pivot pin 148 is locked in a defined position.

The second cam 124 includes an actuating surface 132 that is positioned near the outside of the second cam 124 and gear 128. The actuating surface 132 is configured to engage the pin 156 of the elongated member 144 to enable the pin 156 to rotate the elongated member 144 about the pivot pin 148.

The stripper blade assembly 100 is shown in an unlocked position in FIG. 1. The pivot pin 148 is constrained in the horizontal direction only by the inner cam surface 116, allowing the elongated member 144 to move freely in the other horizontal direction. The elongated member 144 and blade 152 can be manually moved away from the image receiving member 180, for example to clear a paper jam or perform maintenance operations. The actuation surface 132 of the second cam is not engaged with the pin 156 of the elongated member 144 in the unlocked position. Once a maintenance operation is complete, a printer controller (not shown) activates the motor 160 to rotate the output shaft 164 and drive gear 168 in direction 212. The second gear 128 and second cam 124 rotate in direction 208 in response to the motor 160 rotating to rotate the first gear 108 and first cam 104 in direction 204. The outer cam surface 112 and inner cam surface 116 of the first cam 104 limit the horizontal movement as the first cam 104 rotates. This action guides the pivot pin 148 into a precise locked position where the cam surfaces 112, 116 are engaged with the pivot pin 148, as shown in FIG. 2.

Cam surface 112 includes a dwell that constrains the pivot pin 148 in the channel 190. In response to the stripper being rotated against the drum, both the second and the first cams rotate, while pivot pin is constrained within the channel 190 by the dwell portion of the cam surface 112. This dwell portion has a constant radius that is centered at the center of the first gear 108.

Figure 2:
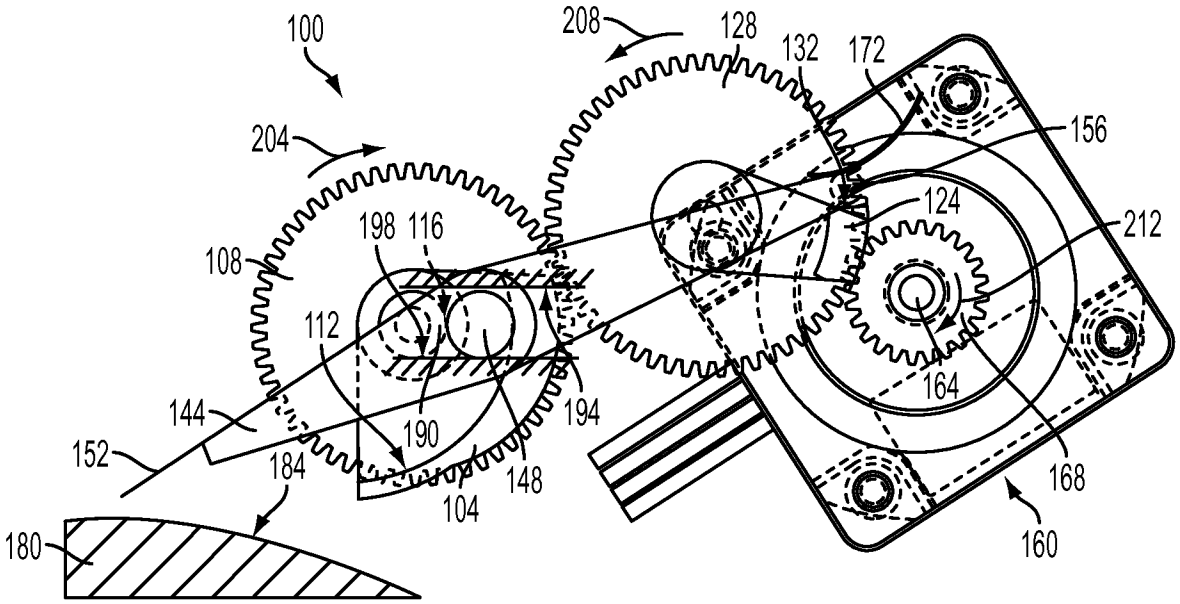
FIG. 2 is a view of the stripper blade assembly of FIG. 1 shown in a locked position.

FIG. 2 illustrates the stripper blade assembly 100 in the locked position. The pivot pin 148 is constrained from vertical movement by the horizontal surfaces 194, 198, while the inner cam surface 116 and outer cam surface 112 prevent horizontal movement of the pivot pin 148. The pivot pin 148 prevents the elongated member 144 from moving vertically or horizontally in the locked position, but allows the elongated member 144 to pivot about the pivot pin 148. In the locked position, the actuating surface 132 of the second cam 124 is engaged with the pin 156 of the elongated member 144, while the blade 152 remains disengaged from the surface 184 of the image receiving member 180.

Figure 3:
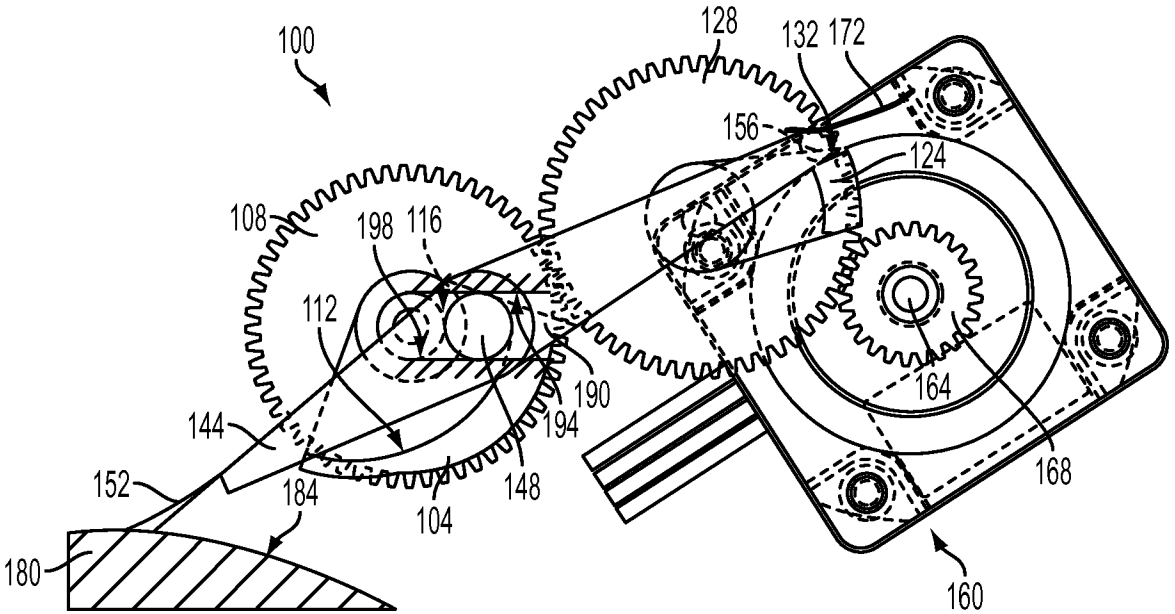
FIG. 3 is a view of the stripper blade assembly of FIG. 1 shown in engagement with an image receiving member.

In response to a media sheet being affixed to the image receiving member 180, the motor 160 turns the output shaft 164 and drive shaft 168 further in direction 212. In response, the second gear 128 and second cam 124 rotate in direction 208. The actuation surface 132 of the second cam 124 forces the pin 156 of the elongated member 144 to pivot the elongated member 144 counter-clockwise about the pivot pin 148 until the blade 152 engages the surface 184 of the image receiving member 180. The blade 152 is designed to deform slightly to accommodate the shape of the surface 184 of the image receiving member 180, as shown in FIG. 3. The movement of the pin and pivoting of the elongated member moves the return spring 172 into the position shown in FIG. 3. In the illustrated embodiment, the return spring 172 is a leaf spring, although a coil spring or other mechanism may be used to store the potential energy from the movement of the second cam. The pivot pin 148 remains constrained from movement in the vertical direction by the channel 190 and from movement in the horizontal direction by the cam surfaces 112, 116 of the first cam 104.

In the position of FIG. 3, the blade 152 is positioned to contact the surface 184 of the image receiving member 180. As the image receiving member 180 with a media sheet (not shown) rotates, the media sheet is forced into the blade 152, which separates the media sheet from the image receiving member 180. This separation allows the media sheet to be directed to an output tray (not shown) of the printer. After the media sheet is separated from the image receiving member 180, the printer controller (not shown) reverses the direction of the motor 160 to rotate the second cam 124 and actuation surface 132 back to the position of FIG. 2. The return spring 172 rotates the elongated member 144 clockwise about the pivot pin 148 and disengages the blade 152 from the surface 184 of the image receiving member 180.

Figure 4:
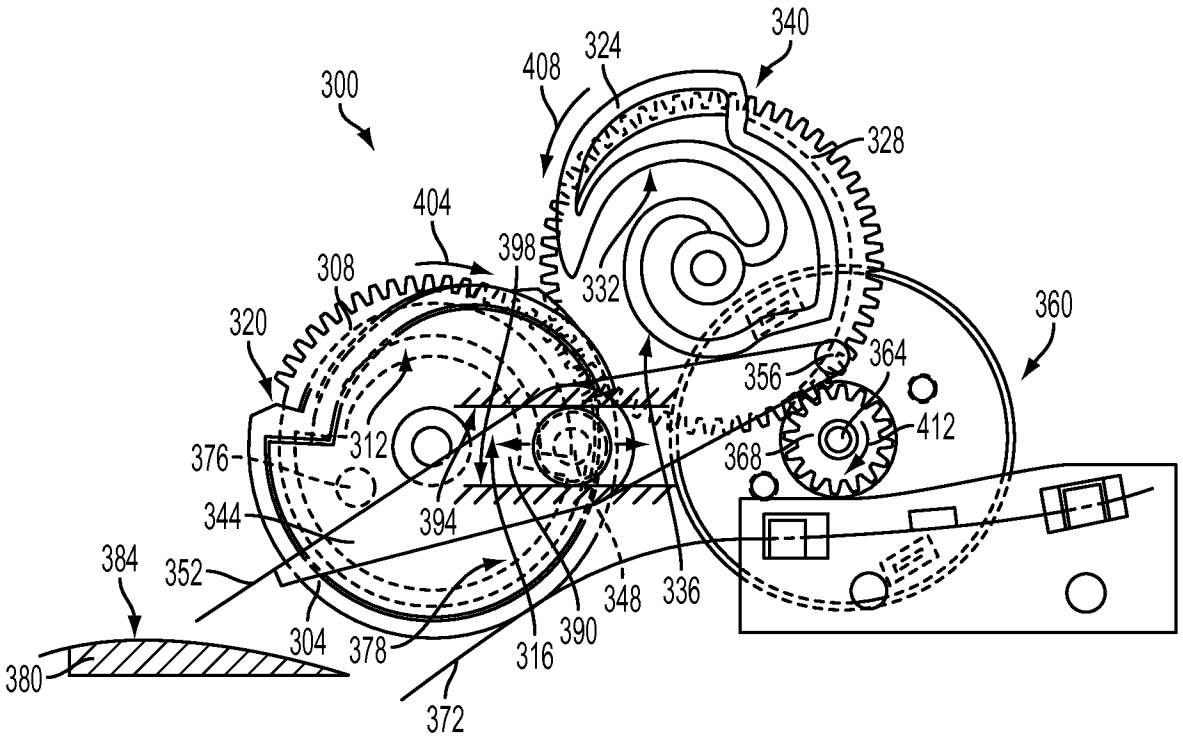
FIG. 4 is a view of another configuration of a stripper blade assembly shown in an unlocked position.

Another configuration of a stripper blade assembly 300 is shown in FIG. 4 in an unlocked position. The stripper blade assembly 300 is positioned in an indirect printer in proximity to an image receiving member 380 having a rotating surface 384. The stripper blade assembly 300 includes a first cam 304, a first gear 308, a second cam 324, a second gear 328, a motor 360, an elongated member 344, a channel 390, a biasing member 372, and a stopping member 376. The first gear 308 is operatively connected to the first cam 304, wherein rotating the first gear 308 rotates the first cam 304. The first gear 304 and the second gear 324 rotate about a common axis. The second gear 328 is operatively connected to the second cam 324 so rotation of the second gear 328 rotates the second cam 324 about a common axis. The first gear 308 and the second gear 328 are substantially coplanar, and the first cam 304 and second cam 324 are positioned between the plane of the first 308 and second 328 gears and the elongated member 344. The second gear 328 has a plurality of teeth around the entire circumference of the second gear 328. The first gear 308 has a plurality of teeth around a portion of the circumference of the first gear 308. In the illustrated embodiment, the first gear 308 has teeth on slightly less than half of the circumference of the first gear 308, although there may be more or less teeth on the first gear 308 in other embodiments. The teeth of the first gear 308 are intermeshed with the teeth of the second gear 328 in the position of FIG. 4 to enable the second gear 328 to rotate the first gear 308. The motor 360 has an output shaft 364 connected to a drive gear 368, the drive gear 368 having teeth that intermesh with the teeth of the second gear 328 to enable the motor 360 to rotate the second gear 328 and cam 324. This rotation simultaneously rotates the first gear 308 and cam 304 when the first gear 308 is engaged with the second gear 328. In the embodiment of FIG. 4, the first gear 308 and second gear 328 are substantially the same size, although in other embodiments one gear may be larger than the other.

The elongated member 344 includes a first end and a second end, the first end having a blade 352 extending beyond the first end of the elongated member 344. A pin 356 is mounted on the second end of the elongated member 344. The pin 356 extends transversely to the length of the elongated member 344 into a space between the elongated member 344 and the second gear 328. The pin 356 is configured to engage cam surfaces on the second cam 324 to guide the position of the pin 356. The elongated member 344 further includes a pivot pin 348 fixedly mounted near the center of the elongated member 344. The pivot pin 348 is substantially cylindrical and is constrained from movement in the vertical direction by two parallel horizontal surfaces 394, 398, which form the channel 390. The pivot pin 348 is configured to engage cam surfaces on the first cam 304 and these cam surfaces guide the horizontal position of the pivot pin 348 when engaged. In the unlocked position depicted in FIG. 4, the pivot pin 348 is restrained in the horizontal direction on one side, and can move to the opposite side.

The first cam 304 includes a curved outer cam surface 312 and a curved inner cam surface 316, which is concentric with the center of the first gear 108. The outer cam surface 312 is positioned outside the inner cam surface 316 and is arranged to enable the distance from the inner cam surface 316 to the outer cam surface 312 to decrease as the first cam 304 is rotated in direction 404. The outer cam surface 312 extends around only a portion of the first gear 108 in the illustrated embodiment. The inner 316 and outer 312 cam surfaces are configured to engage the pivot pin 348 as the first cam 304 rotates in direction 404 to constrain the horizontal movement of the pivot pin 348 until the pivot pin 348 is locked in a defined horizontal position by the cam surfaces 312, 316.

The second cam 324 includes a second inner cam surface 336 and a second outer cam surface 332. The second cam surfaces 332, 336 are configured to engage the pin 356 of the elongated member 344 and enable the second cam surfaces 332, 336 to guide the pin 356 in a defined curved path so the elongated member 344 is pivoted about the pivot pin 348.

The stripper blade assembly 300 is shown in an unlocked position in FIG. 4. The pivot pin 348 is constrained in the horizontal direction only by the inner cam surface 316 to allow the elongated member 344 and blade 352 to be manually moved away from the image receiving member 380, for example, to clear a paper jam or perform maintenance operations. The cam surfaces 332, 336 of the second cam 324 are not engaged with the pin 356 of the elongated member 344 in the unlocked position. When the maintenance operation is complete, a printer controller (not shown) activates the motor 360 to rotate the output shaft 364 and drive gear 368 in direction 412. The second gear 328 and second cam 324 rotate in direction 408 in response to the drive gear 368 rotating so the second gear 328 rotates the first gear 308 and the first cam 304 in direction 404. The outer cam surface 312 and inner cam surface 316 of the first cam 304 limit the horizontal movement of the pivot pin 348 as the first cam 304 rotates, guiding the pivot pin 348 into the precise, locked position shown in FIG. 5. The reader should note that the configuration shown in FIG. 4 does not require a dwell portion for the first cam as the first cam does not rotate during rotation of the stripper against the imaging drum.

Figure 5:
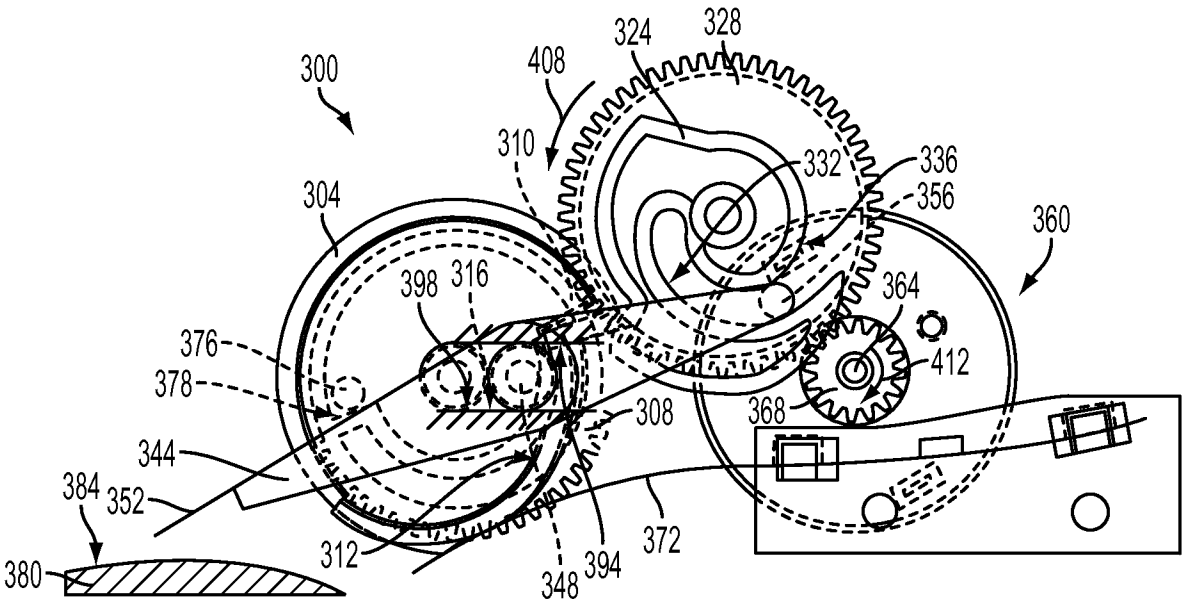
FIG. 5 is a view of the stripper blade assembly of FIG. 4 shown in a locked position.

As the pivot pin 348 moves into the locked position of FIG. 5, the portion of the first gear having no teeth 310 is rotated opposite the teeth of the second gear 328. Thus, the teeth of the first gear 308 no longer intermesh with the teeth of the second gear 328 and rotation of the second gear 328 no longer rotates the first gear 308. A stopping surface 378 on the first gear 308 is positioned on the opposite side of the first gear 308 from the first cam 304 and abuts the fixed stopping member 376 to prevent the first gear 308 and first cam 304 from further rotating. The biasing member 372 exerts a force on the first cam 304 and gear 308 to urge the stopping surface 378 to remain in contact with the stopping member 376 while the first gear 308 is disengaged from the second gear 328 and to prevent the first gear 308 from rotating back into engagement with the second gear 328. The biasing member 372 in the illustrated embodiment is a leaf spring, although a coil spring or other mechanism may be used in other configurations to prevent the cam from rotating.

When the stripper blade assembly 300 moves to the locked position of FIG. 5, the cam surfaces 332, 336 of the second cam 324 engage the pin 356 of the elongated member 344. The blade 352 remains disengaged from the surface 384 of the image receiving member 380. The pivot pin 348 is constrained from vertical movement by the horizontal surfaces 394, 398, while the inner cam surface 316 and outer cam surface 312 of the first cam 304 prevent horizontal movement of the pivot pin 348. The pivot pin 348 thus prevents the elongated member 344 from moving vertically or horizontally while in the locked position, but allows the elongated member 344 to pivot about the pivot pin 348.

Figure 6:
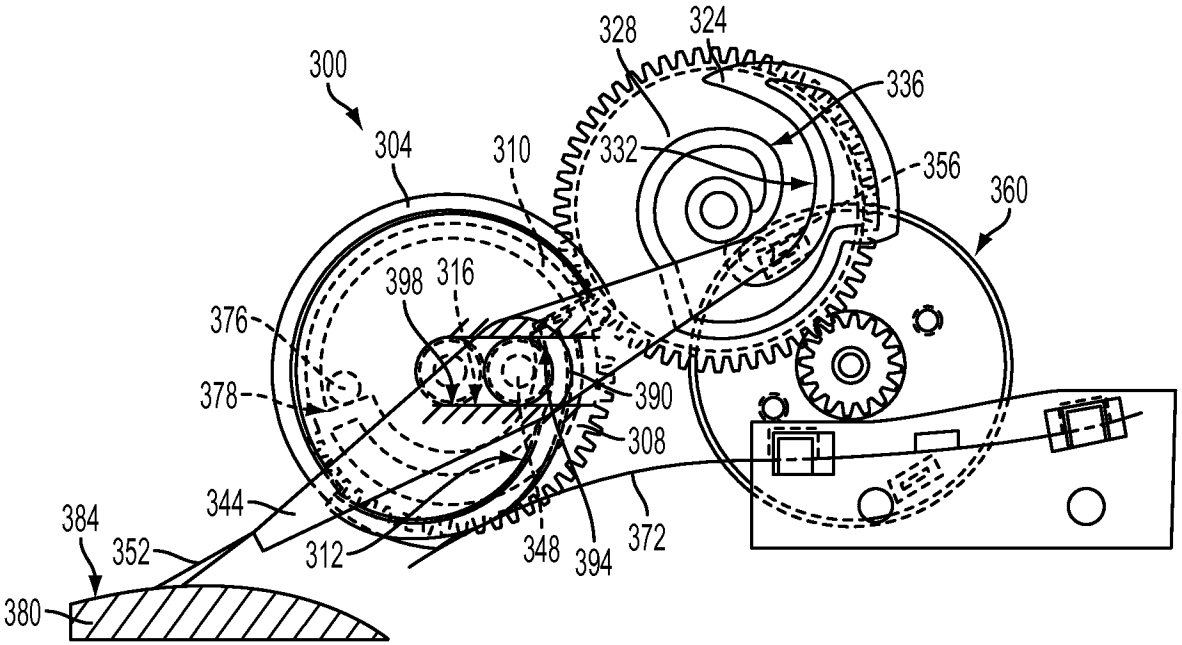
FIG. 6 is a view of the stripper blade assembly of FIG. 4 shown in engagement with an image receiving member.

In response to a media sheet being printed on the image receiving member 380, the motor 360 turns the output shaft 364 and drive shaft 368 further in direction 412. The second gear 328 and second cam 324 then rotate in direction 408. The first gear 308 no longer moves with the second gear 328, as the teeth of the first gear 308 are disengaged from the teeth of the second gear 328. As the second cam 324 rotates, the cam surfaces 332, 336 force the pin 356 of the elongated member 344 to pivot the elongated member 344 counter-clockwise about the pivot pin 348 until the blade 352 engages the surface 384 of the image receiving member 380. In the current configuration, the blade 352 is designed to deform slightly to accommodate the shape of the surface 384 of the image receiving member 380, as shown in FIG. 6. The pivot pin 148 remains constrained from movement in the vertical direction by the channel 390 and is constrained in the horizontal direction by the cam surfaces 312, 316 of the first cam 304.

In the position of FIG. 6, the blade 352 is positioned to contact the surface 384 of the image receiving member 380. Once the media sheet is passed through the transfix nip (not shown), the media sheet, still attached to the image receiving member 380, is forced into the blade 352. The blade 352 separates the media sheet from the image receiving member 380 and the media sheet is directed to an output tray (not shown) of the printer. After the media sheet is separated from the image receiving member 380, the printer controller (not shown) reverses the direction of the motor 360 to disengage the blade 352 from the image receiving member 380 to prevent excess wear on the blade 352 and the surface 384 of the image receiving member 380.

Figure 7:
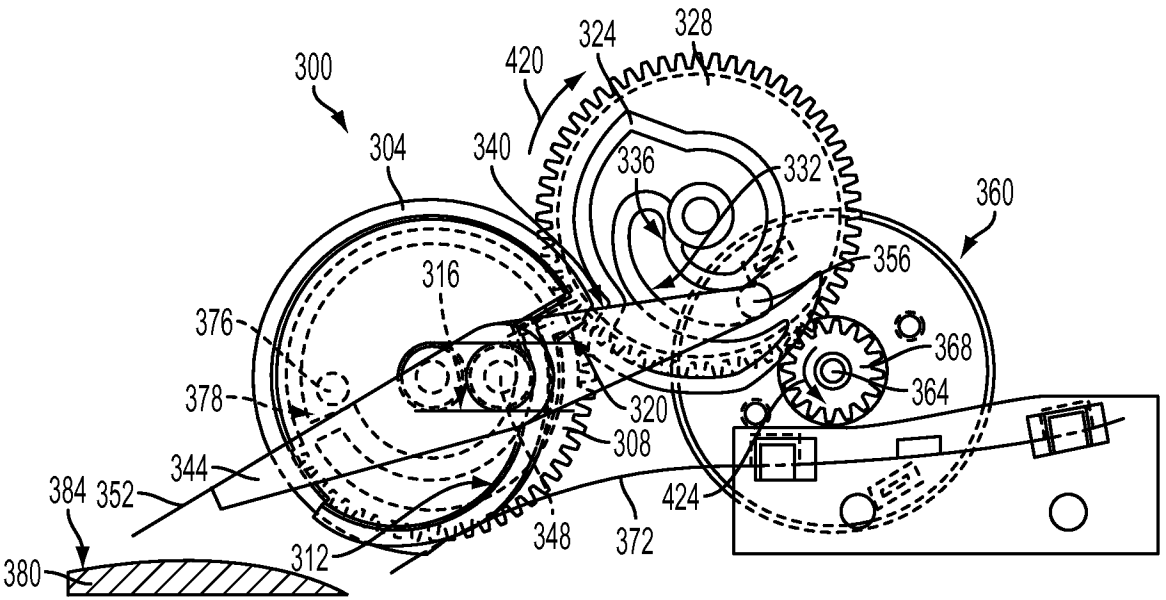
FIG. 7 is a view of the stripper blade assembly of FIG. 4 shown returning to the locked position.

As shown in FIG. 7, when the motor 360 reverses direction, the output shaft 364 and drive gear 368 rotate in direction 424, rotating the second gear 328 and second cam 324 in direction 420. Cam surfaces 332, 336 move the pin 356 and the elongated member 344 pivots clockwise to disengage the blade 352 from the surface 384 of the image receiving member 380. In the position of FIG. 7, the first gear 308 remains disengaged from the second gear 328 and the elongated member 344 remains in the locked position. Thus, the stripper blade assembly 300 is ready to actuate back into the engaged position of FIG. 6 when another media sheet is fed onto the image receiving member 380.

Figure 8:
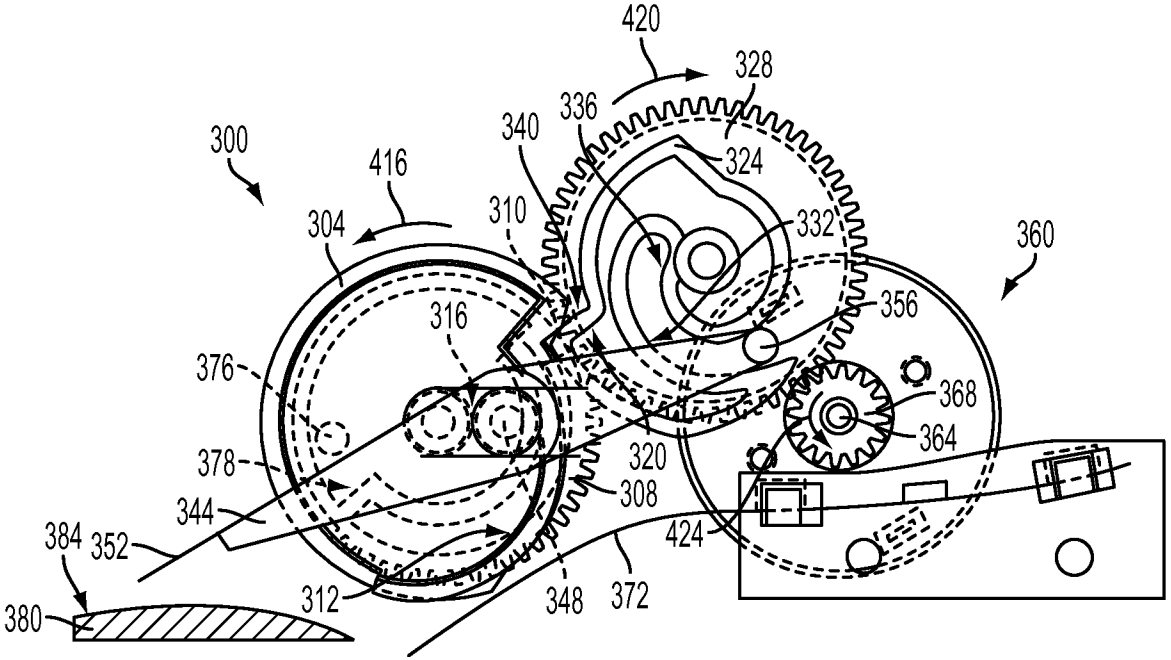
FIG. 8 is a view of the stripper blade assembly of FIG. 4 shown returning to the unlocked position.

When a maintenance operation is required, the motor 360 rotates the output shaft 264 and drive gear 368 further in direction 424, as shown in FIG. 8. The second gear 328 and second cam 324 rotate in direction 420 until the second re-engagement surface 340 contacts the first re-engagement surface 320 of the first cam 304. The force exerted by the second re-engagement surface 340 on the first re-engagement surface 320 causes the first gear 308 and cam 304 to rotate in direction 416. As the first gear 308 rotates, the teeth of the first gear 308 re-engage with the teeth of the second gear 328 to enable the second gear 328 to rotate the first gear 308 through the interaction of the intermeshed teeth. Further rotation of the gears 308, 328 separates the re-engagement surfaces 320, 340. The motor 360 continues to rotate until the stripper blade assembly 300 returns to the position of FIG. 4. The cam surfaces 312, 316 release the pivot pin 348, which allows the pivot pin 348 to move horizontally away from the image receiving member 380 to provide additional clearance for components used in manual maintenance operations on the image receiving member 380 and blade 352.

The above described embodiments of a stripper blade assembly enable the stripper blade to be manipulated for media stripping operations and moved to enable maintenance operations with a single actuator. Additionally, the assembly operates with reduced noise. The mechanism can be adapted to operate a diverter in a media transport system. The mechanism would be the same as the mechanisms described above with the substitution of a diverter arm for the elongated member and blade of the stripper blade assembly. The mechanism is positioned near a junction of a first media path and a second media path. Pivoting of the elongated arm would disrupt the first media path and divert media on the first media path onto the second media path. Reversing the pivot of the elongated arm as explained above would enable media on the first media path to remain on the first media path. Other adaptations are also possible.

Figure 9:
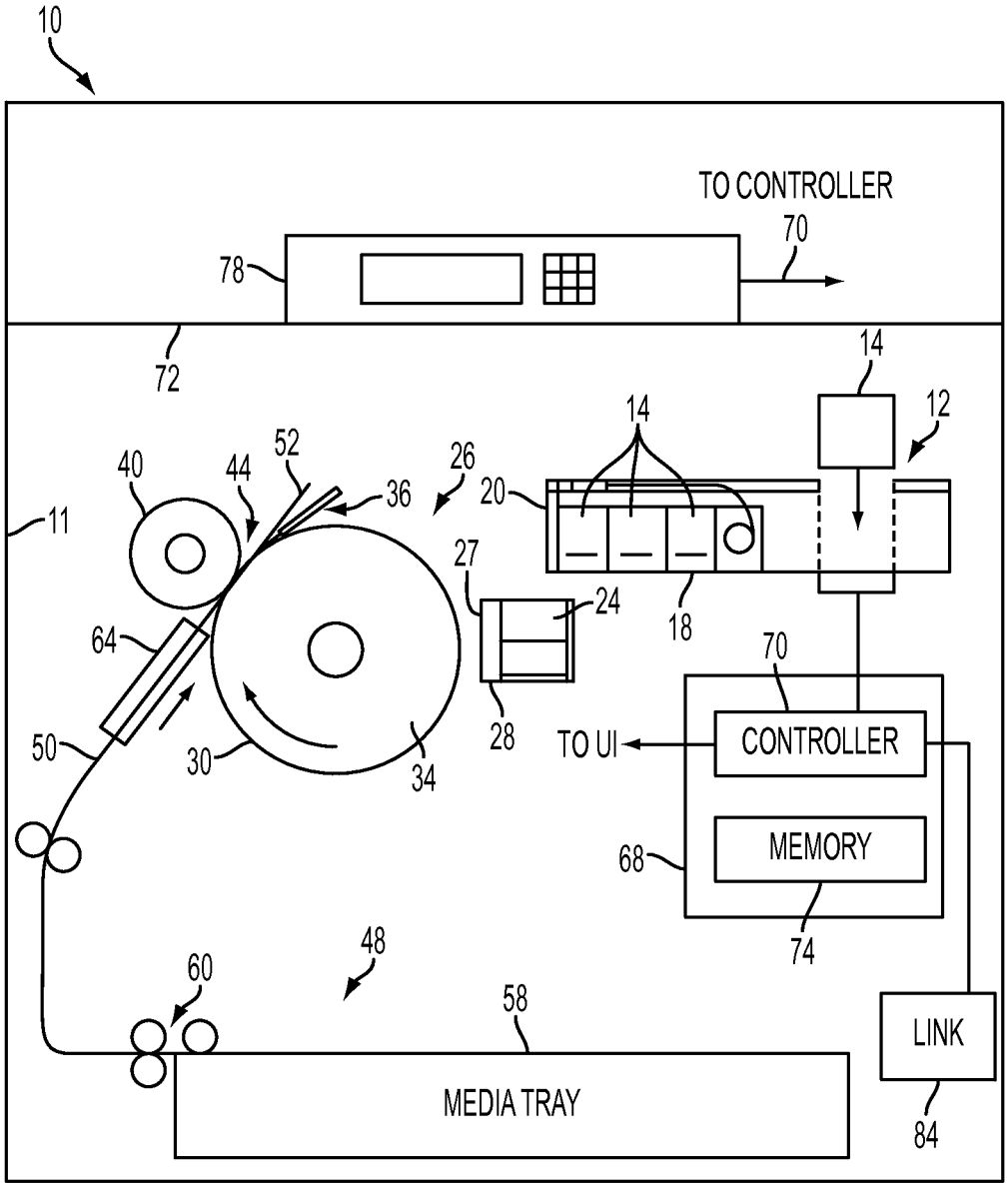
FIG. 9 is a schematic view of a printer that incorporates a stripper blade assembly.

FIG. 9 depicts an exemplary inkjet printer 10 that is configured to incorporate the foregoing stripper blade assemblies. The printer 10 includes a housing 11 that supports and at least partially encloses an ink loader 12, an image forming system 26, a media supply and handling system 48, and a control system 68. The ink loader 12 receives and delivers solid ink units 14 to a melting device 20 for generation of liquid ink. The image forming system 26 includes at least one printhead 28 having a plurality of inkjets that is fluidly connected to a reservoir holding melted ink to receive the ink melted by the melting device 20. The media supply and handling system 48 extracts media sheets from one or more media trays 58 in the printer 10 and synchronizes delivery of the media sheets to a transfix nip 44 for the transfer of an ink image from the image receiving surface 30 to a media sheet 52 that passes through the transfix nip 44. The media supply and handling system 48 delivers the printed sheets to an output area. Control system 68 operates the inkjets in the printhead 28 to eject drops of liquid ink onto the image transfer surface 30 of a rotating image receiving member 34. A stripper blade assembly 36 is positioned proximate to the image receiving member 34. The stripper blade assembly 36 can be embodied by either of the stripper blade assemblies 100 or 300 described above. In the configuration of FIG. 9, the control system 68 engages the stripper blade assembly 36 to the image receiving member 34 to separate the media sheet 52 from the image receiving surface 30. The controller system 68 selectively engages and removes the stripper blade assembly 36 from engagement with the image receiving surface 30 during imaging operations.

Control system 68 aids in operation and control of the various subsystems, components, and functions of the printer 10. The control system 68 is operatively connected to one or more image data sources, such as a scanner, to receive and manage image data from the sources. The control system 68 also generates control signals that are delivered to the components and subsystems of the printer. Some of the control signals, such as firing signals for the printhead, are based on image data, while other control signals regulate the operating speeds, power levels, timing, actuation, and other parameters, of the printer components to cause the printer 10 to operate in various states, modes, or levels of operation, referred to collectively herein as operating modes. These operating modes include, for example, a startup or warm up mode, shutdown mode, various print modes, maintenance modes, and power saving modes.

The control system 68 is configured to ascertain relevant print job characteristics and attributes in a suitable manner, such as by parsing information in image data files or by monitoring the components and sensors of the printer. The print characteristics and attributes obtained by the control system include print media type, print size, fill or coverage level (i.e., percent of the print covered with ink), and whether the print is a simplex (image on one side) or a duplex (image on both sides) print.

The control system 68 includes a controller 70 and electronic storage or memory 74. The controller 70 has a processor, such as a central processing unit (CPU), an application specific integrated circuit (ASIC), a field programmable gate array (FPGA) device, or a micro-controller. Among other tasks, the processor executes programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

The controller 70 is operatively connected to a user interface (UI) 78. User interface (UI) 78 comprises a suitable input/output device positioned on the printer 10 to enable operator interaction with the control system 68. For example, UI 78 may include a keypad and display (not shown). The controller 70 is operatively connected to the user interface 78 to receive signals indicative of selections and other information input to the user interface 78 by a user or operator of the device. Controller 70 is also operatively connected to the user interface 78 to display information to a user or operator including selectable options, machine status, consumable status, and the like. The controller 70 is operatively connected to a communication link 84, such as a computer communication network, for receiving image data files and user interaction data from remote locations.

The ink loader 12 of the printer 10 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 9, the ink loader 12 includes a separate feed channel for each color or shade of color of ink stick 14 used in the printer 10. The feed channel 18 guides ink sticks 14 toward the melting device 20 at one end of the channel 18 where the sticks are heated to a phase change ink melting temperature to melt the solid ink and form liquid ink. Any suitable melting temperature may be used depending on the phase change ink formulation. In one embodiment, the phase change ink melting temperature is in a range of approximately 80° C. to approximately 130° C. In some embodiments, alternative ink loader configurations, ink forms, and ink formulations are used.

The melted ink from the melting assembly 20 is directed gravitationally or by actuated systems, such as pumps, to a melt reservoir 24. A separate melt reservoir 24 may be provided for each ink color, shade, or composition used in the printer 10. Alternatively, a single reservoir housing may be compartmentalized to contain the differently colored inks. As depicted in FIG. 9, the ink reservoir 24 comprises a printhead reservoir that supplies melted ink to inkjet ejectors 27 formed in the printhead(s) 28. The ink reservoir 24 may be integrated into the printhead 28. In alternative embodiments, the reservoir 24 is a separate or independent unit from the printhead 28. Each melt reservoir 24 may include a heating element (not shown) operable to heat the ink contained in the corresponding reservoir to a temperature suitable for melting the ink and/or maintaining the ink in liquid or molten form, at least during appropriate operational states of the printer 10.

The image forming system 26 includes at least one printhead 28. One printhead 28 is shown in FIG. 9 although any suitable number of printheads 28 may be used. The inkjets 27 of the printhead 28 are operated with firing signals generated by the control system 68 to eject drops of ink toward the image receiving surface 30. The printer 10 of FIG. 9 is an indirect printer configured to use an indirect printing process in which the drops of ink are ejected onto the intermediate transfer surface 30 and then transferred to media sheets.

The printer 10 includes a rotating drum 34 as the image receiving member 34, although in alternative embodiments the image receiving member 34 is a moving or rotating belt, band, roller or other similar type of structure. A transfix roller 40 is configured for movement into and out of engagement with the image receiving member. The control system 68 selectively operates an actuator (not shown) to implement this movement. The transfix roller 40 is loaded against the transfer surface 30 of the image receiving member 34 to form a nip 44 through which sheets of print media 52 pass. The sheets are fed through the nip 44 in timed registration with an ink image formed on the transfer surface 30 by the printhead 28. Pressure, and optionally heat, generated in the nip 44 facilitates the transfer of the ink drops from the surface 30 to the print media 52 in conjunction with release agent to substantially prevent the ink from adhering to the image receiving member 34.

The pressure and heat applied to the media sheet 52 may urge the media sheet 52 against the imaging surface 30 after the media sheet exits the transfix nip 44. The stripper blade assembly 36 engages the imaging surface 30 and separates the media sheet 52 from the imaging surface 30 in a controlled manner. The media supply and handling system 48 receives the media sheet 52 after the stripper blade assembly separates the media sheet 52 from the image receiving member 34. The media supply and handling system 48 can move the media sheet 52 to an output area or return the media sheet through a duplex print path to enable duplex printing to a second side of the media sheet 52.

The image receiving member 34 includes an actuator (not shown) that drives the image receiving member to rotate at various predetermined velocities in response to control signals received from the control system 68. The various velocities include an imaging velocity and a transfixing velocity. The control system 68 is configured to operate an actuator to rotate the image receiving member 34 at the imaging velocity during imaging operations, i.e., when the ink images are formed on the transfer surface, and to rotate at the transfixing velocity during transfixing operations, i.e., when the print media are fed through the nip 44 in timed registration with the ink images formed on the transfer surface 30. The imaging and transfixing velocities may be different for different print jobs depending upon the characteristics of the print job, such as print job type, media type, job size, and coverage level, as well as drum surface condition, applicator oil transfer efficiency, properties of the oil, metering blade geometry, and desired oil film thickness. In one embodiment, the imaging velocity and the transfixing velocity are each between approximately 1200 mm/s and 2000 mm/s although any suitable velocity or range of velocities may be used for one or both of the imaging and transfixing velocities.

Media conditioning devices may be positioned at various locations along the media path 50 to prepare the print media thermally to receive melted phase change ink. In the embodiment of FIG. 9, a preheating assembly 64 is utilized to bring print media on media path 50 to an initial predetermined temperature prior to reaching the nip 44. Media conditioning devices, such as the preheating assembly 64, may rely on radiant, conductive, or convective heat or any combination of these heat forms to bring the media to a target preheat temperature, which in one practical embodiment, is in a range of about 30° C. to about 70° C. In alternative embodiments, other thermal conditioning devices may be used along the media path before, during, and after ink has been deposited onto the media.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A pivoting assembly comprising:

an elongated member having a first end and a second end;

a protrusion extending from the elongated member, the protrusion extending transversely to a length of the elongated member from the first end of the elongated member to the second end of the elongated member;

a pivot pin having a first end and a second end, the first end of the pivot pin being mounted through the elongated member at a position that enables the first end and the second end to move in a curved path about the pivot pin;

a channel having a first horizontal planar surface and a second horizontal planar surface, the first planar surface and the second planar surface being parallel to one another and the second end of the pivot pin being positioned between the first horizontal planar surface and the second horizontal planar surface to constrain vertical movement of the pivot pin;

a first cam positioned proximate the channel to enable the first cam to rotate past a portion of the pivot pin between the first end and the second end of the pivot pin and block a portion of the channel to stop horizontal movement of the pivot pin along the channel;

a second cam positioned to enable the second cam to engage the protrusion extending from the elongated member; and an actuator having an output shaft that is operatively connected to the first cam and the second cam, the actuator rotates in a first rotational direction to rotate the second cam and the first cam until the first cam blocks the channel and prevents horizontal movement of the pivot pin in the channel and the second cam engages the protrusion extending from the elongated member and pivots the second end of the elongated member about the pivot pin in a first direction along the curved path to move the first end of the elongated member in the first direction along the curved path, and the actuator rotates in a second rotational direction that is opposite the first rotational direction to enable the elongated member to pivot along the curved path in a direction opposite the first direction, disengage the second cam from the protrusion extending from the elongated member, and move the first cam to a position that does not block the pivot pin in the channel.

2. The pivoting assembly of claim 1 further comprising:

a first gear having teeth positioned on a circumference of the first gear, the first gear operatively connected to the first cam;

a second gear having teeth positioned on a circumference of the second gear, the second gear operatively connected to the second cam and the second gear being positioned to enable the teeth of the second gear to intermesh with the teeth of the first gear; and the actuator output shaft is operatively connected to the first cam and the second cam by operatively connecting the actuator output shaft to at least one of the first gear and the second gear to enable rotation of the actuator to rotate the first gear, the first cam, the second gear, and the second cam.

3. The pivoting assembly of claim 1 further comprising:

a return member configured to urge the elongated member to pivot in the direction opposite the first direction when the actuator rotates in a second rotational direction to reverse pivot the elongated member.

4. The pivoting assembly of claim 2 further comprising:

a portion of the circumference of the first gear having no teeth; and the portion of the first gear having no teeth is opposite the teeth of the second gear when the first cam is blocking the channel and preventing horizontal movement of the pivot pin in the channel.

5. The pivoting assembly of claim 4 further comprising:

a stopping surface on the first gear; and a stopping member that is positioned to engage the stopping surface of the first gear when the portion of the first gear having no teeth is opposite the teeth of the second gear.

6. The pivoting assembly of claim 5 further comprising:

a biasing member operatively connected to the first cam to urge the stopping surface of the first cam against the stopping member while the portion of the first gear having no teeth is opposite the teeth of the second gear.

7. The pivoting assembly of claim 6 wherein the biasing member is a spring.

8. The pivoting assembly of claim 4 further comprising:

a first re-engagement surface on the first cam; and a second re-engagement surface on the second cam, the second re-engagement surface being configured to engage the first re-engagement surface in response to the actuator rotating in the second rotational direction to enable the teeth of the second gear to engage the teeth of the first gear and rotate the first cam in the second direction to enable horizontal movement of the pivot pin.

9. The pivoting assembly of claim 1 further comprising:

a blade mounted to the first end of the elongated member at a position that enables an edge of the blade to extend past the first end of the elongated member; and the elongated member is positioned proximate a rotating image receiving member to enable the pivoting of the elongated member in the first direction to cause the blade to contact a surface of the rotating image receiving member.

10. The pivoting assembly of claim 1 further comprising:

a portion of the first cam being configured as a dwell surface having a constant radius centered at a center of the first gear.

11. The pivoting assembly of claim 1 wherein the elongated member is positioned proximate a first media path to enable the pivoting of the elongated member in the first direction to divert media from the first media path to a second media path.

12. A method for controlling pivoting movement of an elongated member comprising:

rotating an actuator in a first rotational direction;

rotating a first cam with the rotation of the actuator to position a portion of the first cam at a channel formed by two parallel surfaces to block horizontal movement of a pivot pin within the channel, the pivot pin being connected to the elongated member, which has a first end and a second end;

rotating a second cam with the rotation of the actuator to move a surface on the second cam against a protrusion extending from the elongated member, the protrusion extending transversely to a length of the elongated member from the first end of the elongated member to the second end of the elongated member; and further rotation of the second cam with the actuator moves the protrusion in a curved path about the pivot pin to pivot the first end of the elongated member about the pivot pin.

13. The method of claim 12, the rotation of the first cam and the second cam with the actuator further comprising:

rotating a second gear with the actuator, the second gear operatively connected to the actuator and the second cam, the second gear having teeth positioned on a circumference of the second gear, the rotation of the second gear rotating a first gear operatively connected to the first cam in a direction opposite rotation of the second gear, the first gear having teeth positioned on at least a portion of a circumference of the first gear to intermesh with the teeth of the second gear when the portion of the first gear having teeth are positioned opposite the teeth of the second gear.

14. The method of claim 12 further comprising:

positioning a portion of the first gear having no teeth to a position opposite the teeth of the second gear when the protrusion is pivoting the elongated member about the pivot pin;

engaging a stopping member with a stopping surface on the first cam when the portion of the first gear having no teeth is positioned opposite the teeth of the second gear, the stopping member preventing the first gear and the first cam from further rotating; and urging the stopping member and the stopping surface to remain engaged while the portion of the first gear having no teeth is positioned opposite the teeth of the second gear.

15. The method of claim 14 wherein a spring urges the stopping member and the stopping surface to remain engaged.

16. The method of claim 12 further comprising:

rotating the actuator in an opposite rotational direction to reverse the pivoting of the elongated member and engage a first re-engagement surface on the first cam with a second re-engagement surface on the second cam to disengage the stopping surface on the first cam from the stopping member and reengage the teeth of the first gear with the teeth of the second gear.

17. The method of claim 12 further comprising:

pivoting the elongated member with the protrusion to engage an image receiving member surface with a blade extending from the first end of the elongated member.

18. The method of claim 17 further comprising:

pivoting the elongated member with the protrusion to engage the image receiving member surface with the blade in response to a media sheet being on the image receiving member; and pivoting the elongated member in a reverse direction after the blade removes the media sheet from the image receiving member.

19. The method of claim 12 wherein the pivoting of the elongated member moves a blade mounted to the first end of the elongated member into contact with a surface of a rotating image receiving member.

20. The method of claim 12 wherein the pivoting of the elongated member diverts media from a first media path to a second media path.

* * * * *